US006116800A

United States Patent [19]

Wang et al.

[11] Patent Number: 6,116,800

[45] Date of Patent: Sep. 12, 2000

[54] PROPELLING PENCIL

[75] Inventors: Guoyue Wang, Dongjie, Cujerzhuangzhen, Cang County, Hebei 061027, China; Guofeng Wang; Dianjun Wang, both of Hebie, China

[73] Assignee: Guoyue Wang, Hebei, China

[21] Appl. No.: 09/142,287

[22] PCT Filed: Jul. 14, 1997

[86] PCT No.: PCT/CN97/00071

§ 371 Date: Sep. 2, 1998

§ 102(e) Date: Sep. 2, 1998

[87] PCT Pub. No.: WO98/13217

PCT Pub. Date: Feb. 4, 1998

[30] Foreign Application Priority Data

Sep. 24, 1996 [CN] China ..... 96 1 12993

[51] Int. Cl.[7] ..... A45D 46/04

[52] U.S. Cl. ..... 401/68; 401/55; 401/75

[58] Field of Search ..... 401/81, 55, 68, 401/72, 75, 86, 73

[56] References Cited

U.S. PATENT DOCUMENTS

| | | | |
|---|---|---|---|
| 966,172 | 8/1910 | Smith | 401/75 |
| 1,556,701 | 10/1925 | Liddell | 401/68 |
| 4,358,210 | 11/1982 | Hashimoto et al. | 401/65 |
| 4,544,296 | 10/1985 | Jarvis | 401/68 |
| 4,610,557 | 9/1986 | Malm | 401/75 |

FOREIGN PATENT DOCUMENTS

| | | | |
|---|---|---|---|
| 2236950Y | 10/1996 | China | B43K 21/08 |
| 2246583y | 2/1997 | China | B43K 21/08 |
| 423368 | 1/1935 | United Kingdom . | |
| 685653 | 1/1953 | United Kingdom . | |
| 824000 | 11/1959 | United Kingdom . | |
| 1091871 | 11/1967 | United Kingdom | B43K 21/08 |

*Primary Examiner*—David J. Walczak
*Attorney, Agent, or Firm*—Taylor & Aust, P.C.

[57] ABSTRACT

A propelling pencil has a writing core which can be fed out and drawn back controllably and freely. The front portion of the propelling pencil is inserted in the lower end of the shaft of the propelling pencil. The inner surface of the shaft has several ridges which together act as longitudinal guides for the writing core holder. A helical wire, controlling the core holder movement, is formed by winding a flat metal wire. The core holder is made of an elastic material and has a hole therein which has a large diameter at each end thereof and a relatively small diameter at its central region. The core holder is also provided with longitudinal ridges in its lower portion to prevent rotation of the writing core held therein.

6 Claims, 1 Drawing Sheet

PROPELLING PENCIL

TECHNICAL FIELD

The present invention, relates to a writing instrument, especially a propelling pencil in which the stretching out, drawing back and the amount of stretching can be adjusted freely. The writing-core is stable for writing and can be used to replace wooden pencil. This type of propelling pencil is most suitable for children and can be adjusted by themselves easily.

TECHNICAL BACKGROUND

At present the internal component of the same type of the known propelling pencil is not satisfied. The utilization of the limited radial space of the shaft of the propelling pencil is not sufficient, wherein the adjusting core helical is formed of circular metal wire, as such not only the withstanding of the longitudinal pressure is unsufficient but also occupies more radial space, and causing the size of the writing-core holder moving within the space can not be increased for durable; the writing-core holder is easy to split and causing the whole propelling pencil damaged. Both clearance between double-ear and adjusting core helical fitted and interacted with each other, and the coincidence with the guide in the shaft of the propelling pencil are also not satisfied which influences the stability of the writing. The connection of the front portion and the shaft of the propelling pencil is complicated and not convention for manufacturing and using. Moreover, while the writing-core is nearly used up, the internal component may be jammed and damaged; the guide of the inner wall of the shaft is a groove specially made and not easy for using and manufacturing, and also wasting material. The mold is difficult to manufacture. Therefore, propelling pencil of the same type has not been practical yet.

SUMMARY OF THE INVENTION

The object of the present invention is to provide a kind of propelling pencil which is practical, durable, convenient, low-cost and high utilization of the writing-core.

The object of the present invention can be achieved by the following propelling pencil.

In order to ensure the stable writing of writing-core, it is necessary for adjusting core helical itself to have endurance of longitudinal pressure and reducing the limited radial space occupied by it within the shaft of the propelling pencil, for the benefit of increasing the outer diameter and durable of the writing-core holder which is engaged and moves within the shaft of the propelling pencil. The adjusting core helical is formed by a flat metal wire which is used along its longitudinal direction, i.e., the helical is formed in such a manner that one of the two wider outer surfaces of the flat wire faces towards the axis of the helical. To compare with two adjusting core helices formed by flat and circular wire with same cross-sectional area and same metal wire, the former not only withstands larger longitudinal pressure but also occupies smaller radial space.

To avoid the internal component to be jammed and damaged when the writing-core is nearly used up and reduce unnecessary links for convenient for using and manufacturing, reduce cost and make a sufficient use of the writing-core, etc., the front portion of the propelling pencil is inserted directly into the lower end of the shaft of the propelling pencil and can be easily taken-off and put-on. The front portion of the propelling pencil can be pushed back to the original position by an internal component when the writing-core is nearly used up.

In order to conveniently use and manufacture the shaft of the propelling pencil, and save material and conveniently insert the double-ear of the holder into the guide of the shaft of the propelling pencil without seeking the way when fitting the writing-core into it. In the inner wall of the shaft a number of pairs of longitudinal ridges with substantially the same shape, size and distance spaced each other are provided. A number of longitudinal grooves with substantially the same width are formed between the ridges, any pair of these grooves can be served as a guide which controls the moving direction of the writing-core holder in the shaft of the propelling pencil.

In order to prevent the writing-core holder splitting easily from damage the whole pencil and improve the clearance between double-ear of the writing-core holder and the adjusting core helical to which the holder is engaged with and the coincidence of the double-ear with the guide of the inner wall of the shaft of the propelling pencil, improve the stability of writing, reduce the resistance when which the holder is driven, etc., the writing-core holder is made of flexible material with suitable elasticity and increasing the outer diameter of the writing-core holder by utilizing the radial space which is saved by using the flat wire to form the adjusting writing-core helical.

In order to prevent the writing-core holder splitting easily and enhance the clamping force to the writing-core and improve the adaptation to the different diameters of the writing-core, a writing-core fitting hole in the lower end of the writing-core holder is provided in such a manner that the diameter of the core fitting hole is larger than the diameter of the writing core and reducing its diameter gradually from outside to inside, at the intermediate section of the total length of the core fitting hole the diameter of the hole is minimum and smaller than the diameter of the core which is fitted. The diameter from intermediate section to the bottom (the "bottom" of the hole here referring to the location to which the top of the core is touched) of the hole is larger.

In order to prevent the rotation of the writing-core when it is sharpened, a number of pairs of longitudinal ridges are provided in the wall of the core fitting hole of the writing-core holder from the middle section to the bottom.

DETAILED DESCRIPTION

Figure 1:
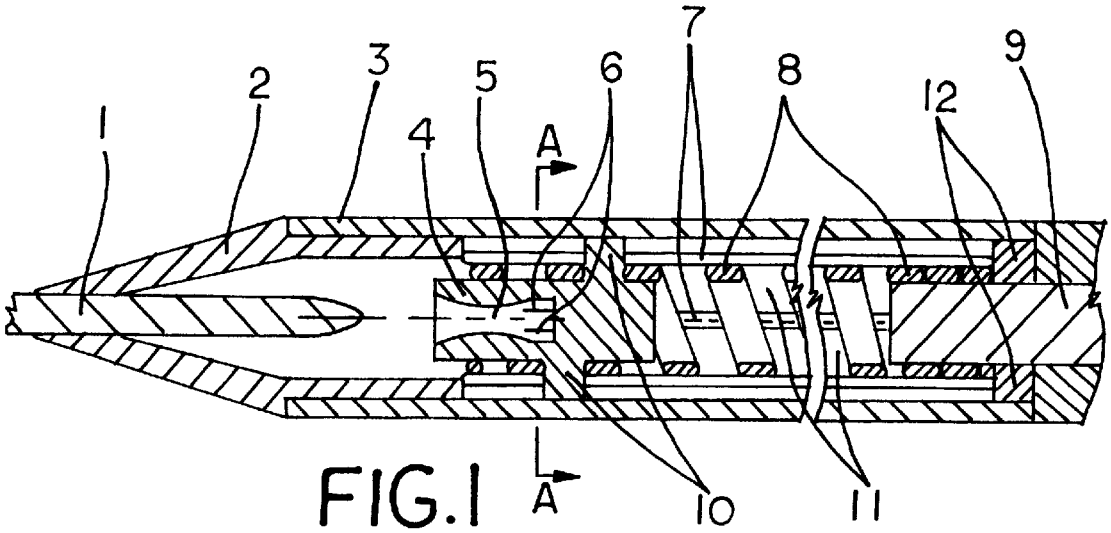
FIG. 1 is a longitudinal, sectional view of the propelling pencil of the present invention.
Figure 2:
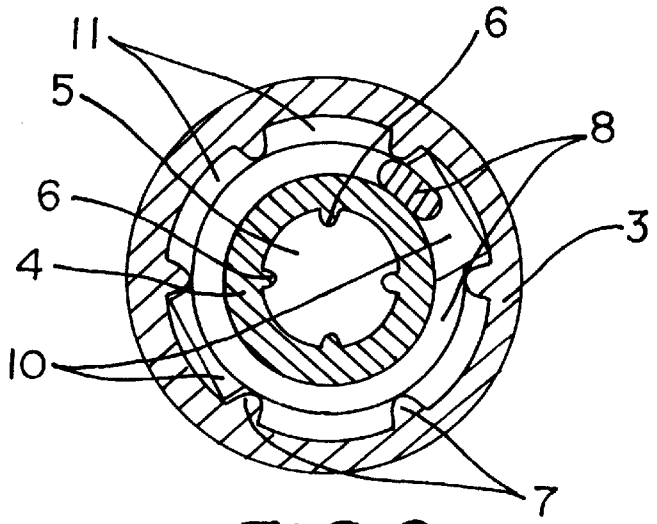
FIG. 2 is a cross-sectional view along line A—A of FIG. 1.

The front portion 2 of the propelling pencil is inserted in the lower end of the shaft 3 of the propelling, pencil. In the inner wall of the shaft 3 of the propelling pencil a number of pairs of longitudinal ridges 7 are provided. Several pairs of groove guides 11 are formed between these ridges 7. Adjusting core helical 8 is made of flat metal wire and the writing-core holder 4 is engaged therein. Double-ear 10 of the writing-core holder 4 engages into the groove guide 11 through the gaps between the wires of the adjusting core helical 8. Writing-core holder 4 can rotate relative to the shaft 3 of the propelling pencil and can move alone guide 11 only. Writing core 1 is inserted into the core-fitting hole 5 of the writing-core holder 4 through the hole of the front portion 2 of the propelling pencil. Several pairs of longitudinal ridges 6 are provided on the lower section of the core-fitting hole 5. Ridges 6 and the writing-core head which is in the duck-billed shape or other corresponding shape are interacted and it can prevent writing-core 1 from rotation relative to the shaft 3 of the propelling pencil while sharpening. Adjusting core helical 8 is provided within shaft 3 and at its top end is connected firmly with the adjusting core button 9. Adjusting core helical 8 can not move upwards due to the limitation of the stop-ring 12 or the shaft 3 of the propelling pencil at the upper opening, and can rotate only relative to shaft 3. The rotation of the adjusting core button 9, in turn, rotates the adjusting core helical 8 and will drive the writing core holder 4 up and down along the gap between the wires and the groove guide. Thereby, the stretching out or drawing back of the writing core 1 in the hole of the front portion 2 of the propelling pencil will be adjusted.

A preferred embodiment of the invention

The present invention comprising a front portion of the propelling pencil, a shaft of the propelling pencil, an adjusting core button, an adjusting core helical, a writing-core holder and writing-core. The front portion of the propelling pencil is inserted directly in the lower end of the shaft of the propelling pencil. When it is necessary to replace the writing-core the front portion can be easily taken-off and put-on. The adjusting core button is fitted on the upper end of the shaft of the propelling pencil and can rotate freely. The connection of the portion of the adjusting core button within the shaft and the upper end of the adjusting core helical which can relatively rotate in the shaft of the propelling pencil is fixedly inserted. The writing-core holder is engaged with the writing-core helical. The writing-core is inserted into the core fitting hole of the lower end of the writing-core holder. In the inner wall of the shaft of the propelling pencil a number of pairs of longitudinal ridges with the substantially same shape, size and distance spaced each other are provided ("pair" here indicating each two opposite longitudinal ridges along two opposite points at the inner diameter of the shaft). The longitudinal grooves with substantially same width are formed oppositely by these ridges. Any pair of these grooves can be served as a guide of controlling the movement of the writing-core holder when it is driven in the shaft of the propelling pencil. Adjusting core helical fitted in the shaft is a tube-like helical wound by flat metal wire between which there are gaps. The flat wire is wound along the longitudinal direction of the tube-like helical, that is one of the two wider outer surfaces faces towards the axis of the tube-like helical during winding. On each side of the writing-core holder provides with a projection, i.e. two projections or called double-ear is provided on the holder, which can engage with the gaps between wires of the adjusting core helical and with the guide of the shaft of the propelling pencil. Double-ear engages into the gaps between wires and the guide of the shaft, when the adjusting core button rotates, the adjusting core helical rotates. The adjusting core helical drives the writing-core holder engaged within it up and down along the gaps between wires and the guide in the shaft so that the writing-core moves simultaneously. The stretching out or drawings back or the amount of the stretching in the hole of the front portion can be adjusted. When it is necessary to replace the writing-core, it can be achieved directly through the hole of the front portion of the shaft or achieved by taking off the front portion of the shaft, or further achieved after taking off the front portion of the shaft and the writing-core holder. In order to sharpen the tip of the writing-core without rotation, one end of the writing-core fitted into the hole can be sharpened with a duck-billed shape and then fitted it in.

Industrial applicability

Since adopting the scheme mentioned above, the present invention propelling pencil not only reduces the unnecessary links, convenient to manufacture mold, easy to produce and use, saves material and lowers cost, but also has very good practical performance. The present invention is most suitable for children who consume most of wooden pencil. Comparing with wooden pencil to which sometimes children have difficult to use it directly, the present invention releases the difficulty of using wooden pencil from children and saves great amount of wood resource. It has the economical and social benefits and also suitable for industrial mass production.

What is claimed is:

1. A propelling pencil comprising:

a shaft having an inner wall, said inner wall having longitudinal guides formed therein, said shaft having a lower end and an upper end;

a writing core holder movably located within and along a longitudinal direction of said shaft, said writing core holder engaged with and movable along at least one of said longitudinal guides in said inner wall, said writing core holder having a hole therein configured for holding a writing core, said writing core holder hole having a top, a bottom and an intermediate section, said writing core holder hole having a diameter largest at said top and said bottom, said diameter of said hole decreasing toward said intermediate section, said diameter at said top and said bottom being configured to be greater than a diameter of the writing core and said diameter at said intermediate section being configured to be smaller than the diameter cf the writing core;

an adjusting core helical positioned within said shaft, said adjusting core helical couplingly engaged with an outer portion of said writing core holder;

an adjusting core button rotatably mounted in said upper end of said shaft and rotatably coupled with an end of said adjusting core helical, said adjusting core button being configured for driving said adjusting core helical within said shaft and for thereby adjusting a longitudinal position of said writing core holder within said shaft; and a front portion directly inserted in said lower end of said shaft, said front portion configured for easy insertion into and removal from said lower end of said shaft.

2. The propelling pencil according to the claim 1, wherein said adjusting core helical is made of flat metal wire.

3. The propelling pencil according to the claim 1, wherein said inner wall of said shaft has a number of pairs of said longitudinal ridges with substantially a same shape and size, said ridges being equally spaced from each other, said longitudinal ridges together comprising a number of pairs of said longitudinal guides, said longitudinal guides each having a groove-shape, said groove-shaped guides being configured to control the longitudinal movement of the writing-core holder.

4. The propelling pencil according to the claim 1, wherein said writing core holder is made of a material with slight flexibility and suitable elasticity.

5. A propelling pencil comprising:

a shaft having an inner wall, said inner wall having longitudinal guides formed therein, said shaft having a lower end and an upper end;

a writing core holder movably located within and along a longitudinal direction of said shaft, said writing core holder engaged with and movable along at least one of said longitudinal guides in said inner wall, said writing core holder having an inner wall, said inner wall of said writing core holder defining a hole configured for holding a writing core therein, said writing core holder having a top section and a bottom section, said bottom section thereof facing said lower end of said shaft, said writing core holder having a number of pairs of longitudinal ridges on said inner wall thereof within said bottom section thereof;

an adjusting core helical positioned within said shaft, said adjusting edge helical couplingly engaged with an outer portion of said writing core holder;

an adjusting core button rotatably mounted in said upper end of said shaft and rotatably coupled with an end of said adjusting core helical said adjusting core button being configured for driving said adjusting core helical within said shaft and for thereby adjusting a longitudinal position of said writing core holder within said shaft; and a front portion directly inserted in said lower end of said shaft, said front portion configured for easy insertion into and removal from said lower end of said shaft.

6. The propelling pencil according to claim 5, wherein said adjusting core helical is comprised of a helical of flat metal wire.

* * * * *